US010850538B2

(12) United States Patent
Culubret et al.

(10) Patent No.: US 10,850,538 B2
(45) Date of Patent: Dec. 1, 2020

(54) SUPPORTING A ROLL OF PRINT MEDIA

(71) Applicant: HEWLETT-PACKARD DEVELOPMENT COMPANY, L.P., Houston, TX (US)

(72) Inventors: Sergi Culubret, Sant Cugat del Valles (ES); Lluis Valles, Sant Cugat del Valles (ES); Lluis Hierro, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/149,685

(22) Filed: Oct. 2, 2018

(65) Prior Publication Data

US 2019/0030922 A1 Jan. 31, 2019

Related U.S. Application Data

(62) Division of application No. 15/329,066, filed as application No. PCT/US2014/048785 on Jul. 30, 2014, now Pat. No. 10,118,415.

(51) Int. Cl.

| | |
|---|---|
| ***B41J 11/58*** | (2006.01) |
| ***B41F 13/00*** | (2006.01) |
| ***B65H 23/188*** | (2006.01) |
| ***B65H 19/12*** | (2006.01) |
| ***B41F 13/03*** | (2006.01) |

(52) U.S. Cl.

CPC ..... *B41J 11/58* (2013.01); *B41F 13/03* (2013.01); *B65H 19/126* (2013.01); *B65H 23/188* (2013.01); *B65H 2301/41346* (2013.01); *B65H 2301/41722* (2013.01); *B65H 2301/413526* (2013.01); *B65H 2403/41* (2013.01); *B65H 2403/942* (2013.01); *B65H 2801/12* (2013.01)

(58) Field of Classification Search

None

See application file for complete search history.

(56) References Cited

U.S. PATENT DOCUMENTS

| | | | | |
|---|---|---|---|---|
| 2,107,020 A | | 2/1938 | Williams | |
| 3,695,539 A | * | 10/1972 | Lindstaedt | B65H 16/021 198/432 |
| 4,179,077 A | | 12/1979 | Morishita | |
| 4,821,974 A | | 4/1989 | Poehlein | |
| 5,421,553 A | | 6/1995 | Hashiue | |
| 5,421,691 A | | 6/1995 | Ferrone | |
| 5,785,441 A | | 7/1998 | Kobayashi et al. | |
| 6,244,699 B1 | | 6/2001 | Barque et al. | |

(Continued)

FOREIGN PATENT DOCUMENTS

| | | |
|---|---|---|
| DE | 102006005785 A1 | 8/2007 |
| JP | 2011104957 | 6/2011 |

(Continued)

*Primary Examiner* — Alejandro Valencia

(74) *Attorney, Agent, or Firm* — HP Inc. Patent Department

(57) ABSTRACT

In one example, an elevator for a roll of print media includes rotatable shafts oriented parallel to one another and translatable supports to support a roll of print media. Each support is operatively connected to the shafts such that rotating the shafts in a first direction raises the supports and rotating the shafts in a second direction opposite the first direction lowers the supports.

14 Claims, 15 Drawing Sheets

(56) References Cited

U.S. PATENT DOCUMENTS

| | | | | |
|---|---|---|---|---|
| 7,967,515 | B2 | 6/2011 | Puigardeu et al. | |
| 9,371,897 | B2 * | 6/2016 | Rademakers | F16H 37/082 |
| 2008/0218541 | A1 | 9/2008 | Tezuka et al. | |
| 2011/0102505 | A1 * | 5/2011 | Kagami | B41J 3/543 347/37 |
| 2012/0012016 | A1 | 1/2012 | Moeller | |
| 2012/0091250 | A1 * | 4/2012 | Tenpaku | B65H 19/126 242/596 |
| 2013/0043340 | A1 * | 2/2013 | Tenpaku | B65H 19/126 242/598.2 |

FOREIGN PATENT DOCUMENTS

| | | |
|---|---|---|
| JP | 2012030413 | 2/2012 |
| WO | WO-2014065759 | 5/2014 |

* cited by examiner

SUPPORTING A ROLL OF PRINT MEDIA

BACKGROUND

Many large format printers print on a web of paper or other print media dispensed from a roll that may be a meter wide or wider. A full roll of such print media is heavy. Consequently, it is often desirable to support the roll on a support when positioning the roll for installation in the printer.

DRAWINGS

FIGS. 1-3 illustrate a printer implementing one example of a new elevator for loading a roll of print media into the printer. FIG. 1 shows the roll on the elevator in a loading position. FIG. 2 shows the roll on the elevator raised to the dispensing position. FIG. 3 shows the roll secured in the printer in the dispensing position and the elevator lowered away from the roll.

The same part numbers designate the same or similar parts throughout the figures.

DESCRIPTION

For print media rolls that are too heavy for a user to comfortably lift into position when loading the roll in the printer, some large format printers include supports that support each end of the roll as it is raised into position and secured in the printer. Each support is raised manually with a cam or a screw, incrementally first on one end of the roll and then on the other end of the roll until the roll is aligned with the holders. The holders can then be attached to the roll, the supports lowered, and the print media web dispensed for printing. The distance the supports are raised to reach the dispensing position varies depending on the diameter the print media roll. For heavier rolls, significant user effort may be needed to turn the cams or the screws to raise the supports. For cams and screws with a greater mechanical advantage, the user must turn the cam or screw many times to raise and lower the support. In any case, the user must raise and lower each support individually at each end of the roll.

A new system has been developed for raising a print media roll into the dispensing position to reduce the time and effort the user must expend to load the roll into the printer. In one example of the new system, an elevator for the roll includes two rotatable shafts oriented parallel to one another and two supports on the shafts. Each support is operatively connected to both shafts with a linear actuator so that rotating the shafts in one direction simultaneously raises both supports and rotating the shafts in the opposite direction simultaneously lowers both supports. While the shafts may be rotated together manually with a crank and still realize advantages over existing systems, it is expected that most implementations will utilize an electric motor to turn the shafts to minimize user time and effort. The user need only place the roll on the supports and energize the motor (or turn the crank) to raise both ends of the roll at the same time, with less effort compared to lift existing systems. More or fewer than two supports may be used. Indeed, one of the advantages of a motorized version of the elevator is the ability to apply greater forces to lift heavier rolls, for example with a single stationary support straddling the center of the roll.

These and other examples shown in the figures and described herein illustrate but do not limit the invention, which is defined in the Claims following this Description.

As used in this document, "motoring" means causing or imparting motion with an electric motor; "dispensing elevation" means an elevation at which print media may be dispensed from a roll for printing; "dispensing position" means a position from which print media may be dispensed from a roll for printing; and "translate" means to move in a straight line.

Figure 1:
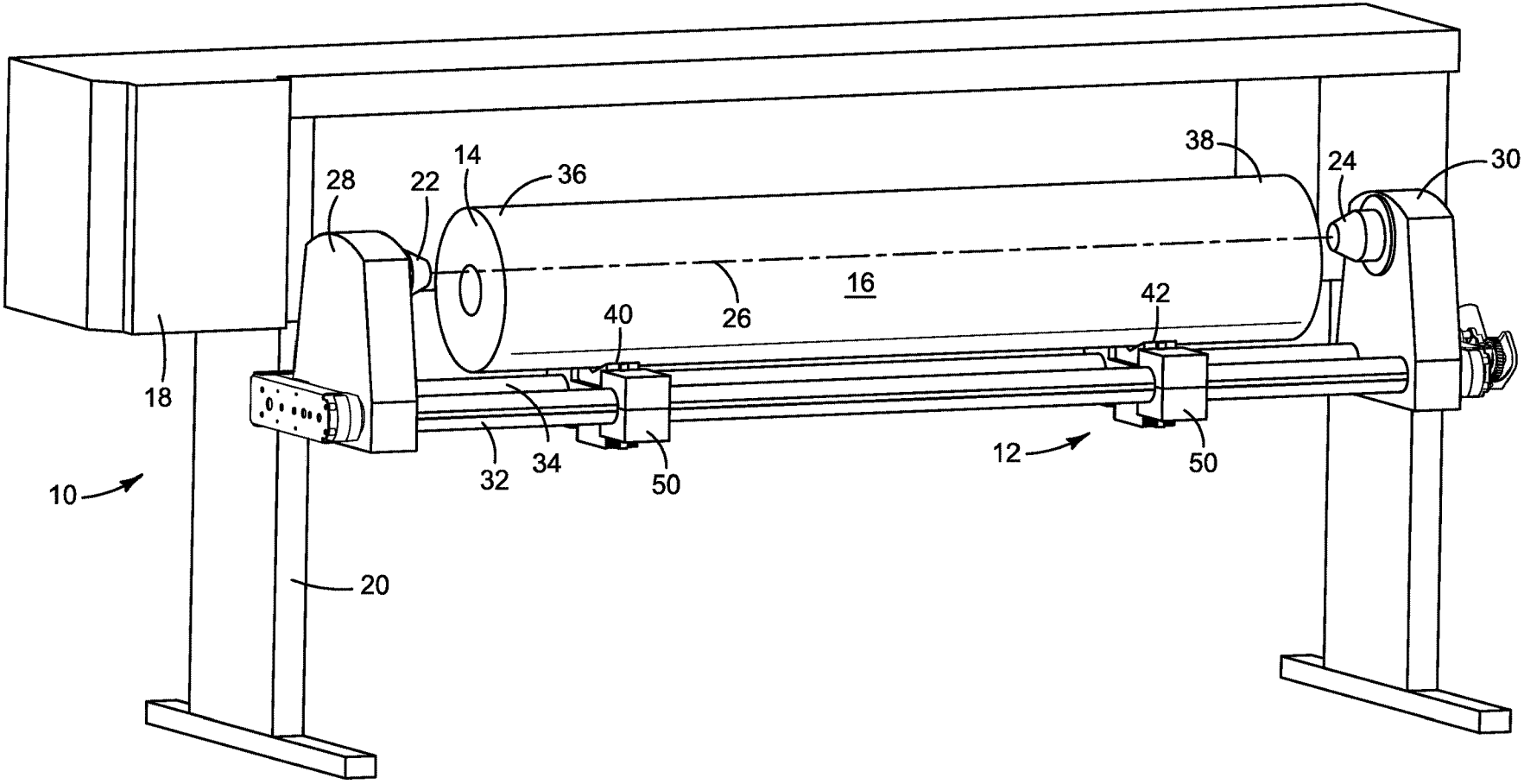
Figure 2:
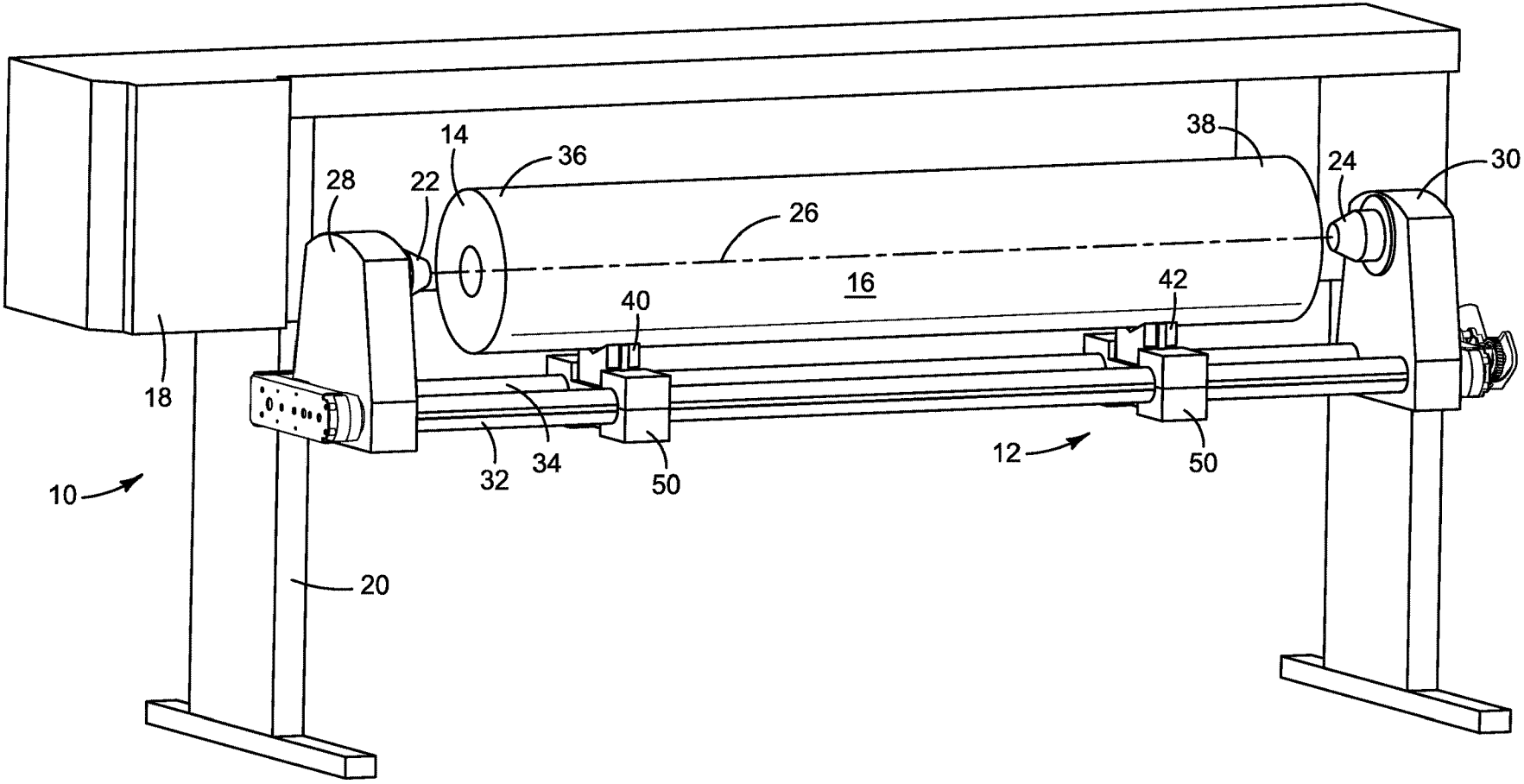
Figure 3:
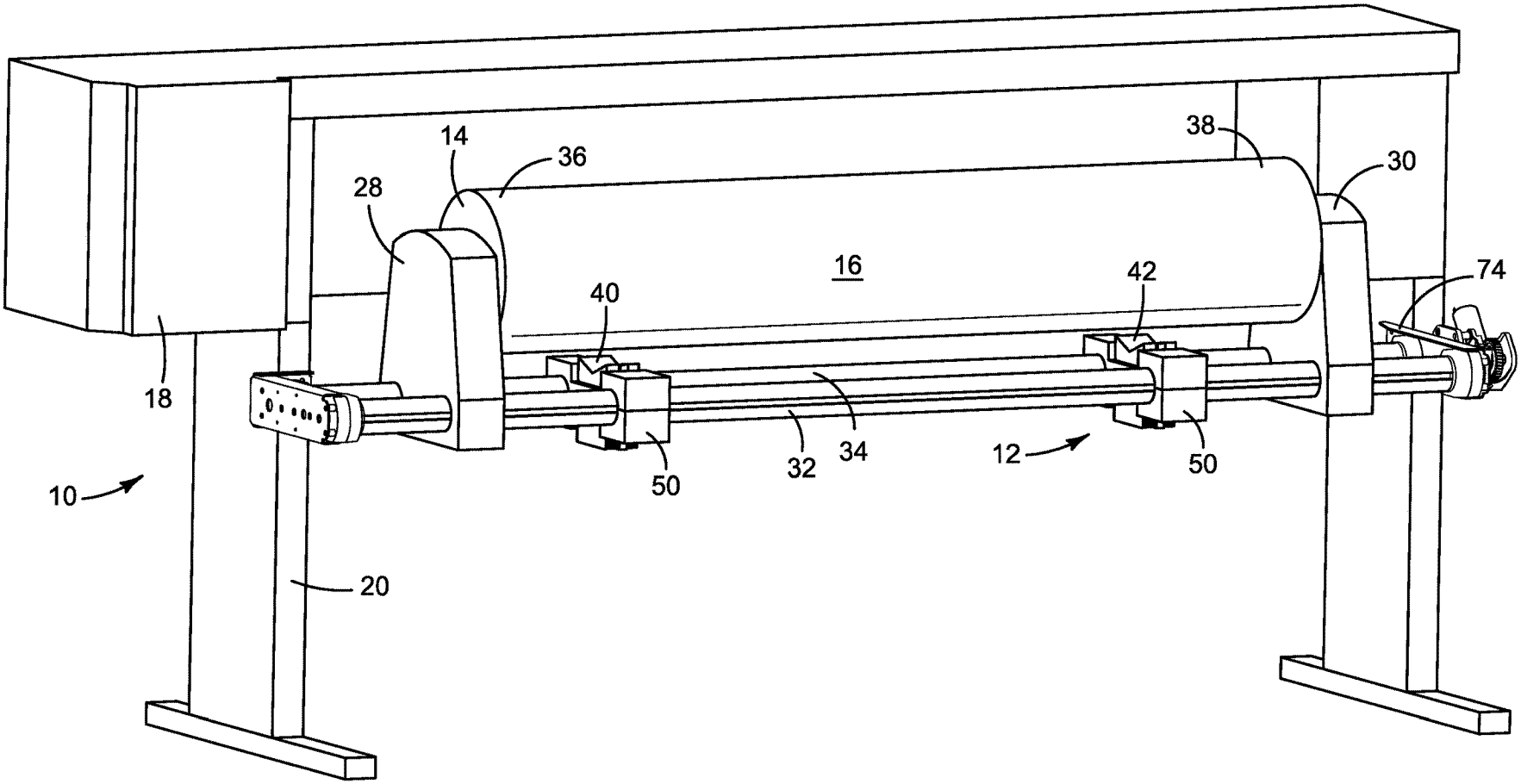
Figure 4:
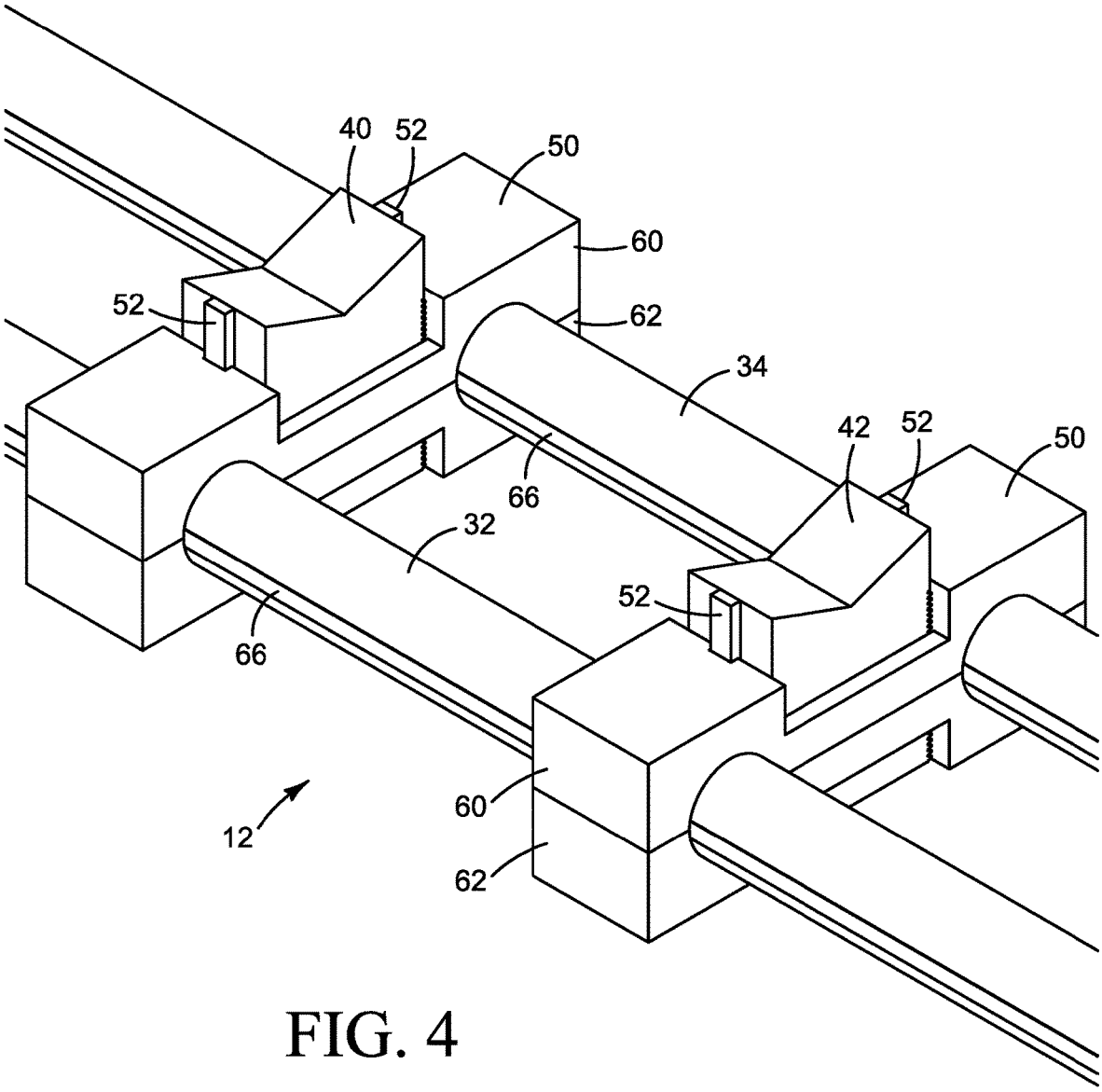
FIG. 4 is a close-up of one example of the support assemblies in the elevator shown in FIGS. 1-3.

FIGS. 1-3 illustrate a printer 10 implementing one example of an elevator 12 for loading a roll 14 of print media 16 into the printer. FIG. 1 shows roll 14 on the elevator supports in a loading position. FIG. 2 shows roll 14 on the elevator supports raised to the dispensing position. FIG. 3 shows roll 14 secured in printer 10 in the dispensing position and the elevator supports lowered away from roll 14. Referring to FIGS. 1-3, printer 10 includes a housing 18 supported on a stand 20. A print engine, controller and other operative components of printer 10 are housed in housing 18 and supported on stand 20 to print on media 16. Any printing technology suitable for printing on a web of paper or other print media 16 may be used. Also, although a stand-alone printer 10, elevator 12 may be implemented in other types of printers.

As shown in FIG. 3, roll 14 is held in a dispensing position by holders 22, 24 positioned opposite one another along an axis 26. Each holder 22, 24 is mounted to a car 28, 30 on an axle with a bushing or other operative connection that allows the holders to rotate to unwind media 16 from roll 14. Cars 28, 30 are mounted on shafts 32, 34 that extend across the width of the print zone parallel to axis 26. Cars 28, 30 slide along shafts 32, 34 between a dispensing position shown in FIG. 2 in which each holder 22, 24 engages and holds the ends 36, 38 of roll 14, and a loading or unloading position shown in FIGS. 1 and 2 in which each holder 22, 24 is disengaged and away from the ends 36, 38 of roll 14.

Each car 28, 30 includes a brake (not shown) to keep the cars parked for printing in the dispensing position. The brake may be as simple as a set screw setting each car 28, 30 against one or both shafts 32, 34 or a more complex braking system for more robust braking. Cars 28, 30 slide along shafts 32, 34 to various dispensing, loading and unloading positions and to accommodate different width media rolls 14. In the example shown in FIGS. 1-3, media 16 is dispensed from a supply roll 14 to the print engine. In other examples, elevator 12 may be used to unload a roll of printed media discharged from the print engine after it has been collected on a take-up spool.

Figure 8:
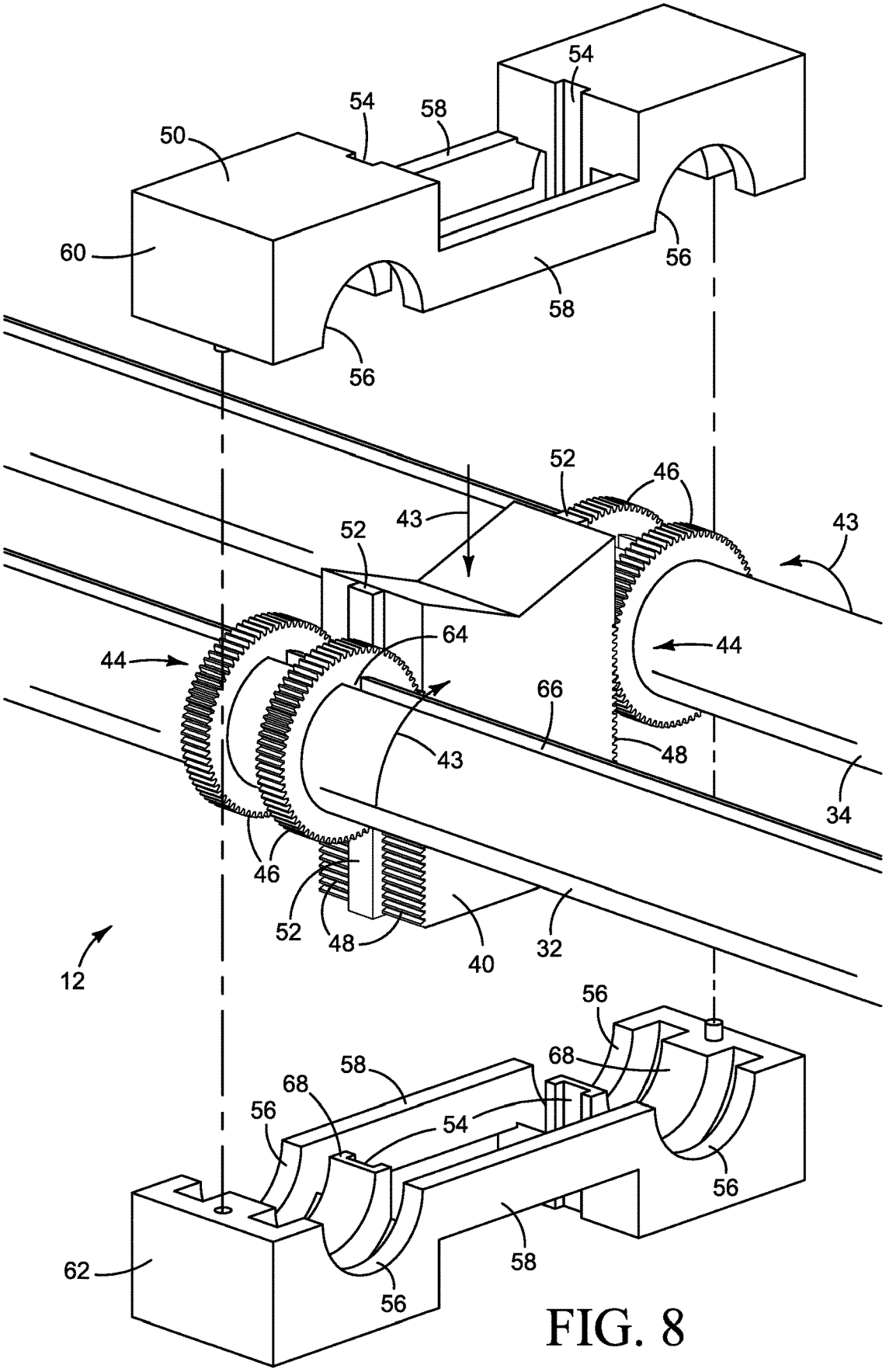
FIGS. 8 and 9 illustrate shaft rotation for raising and lowering the supports using the linear actuator of FIG. 7.
Figure 9:
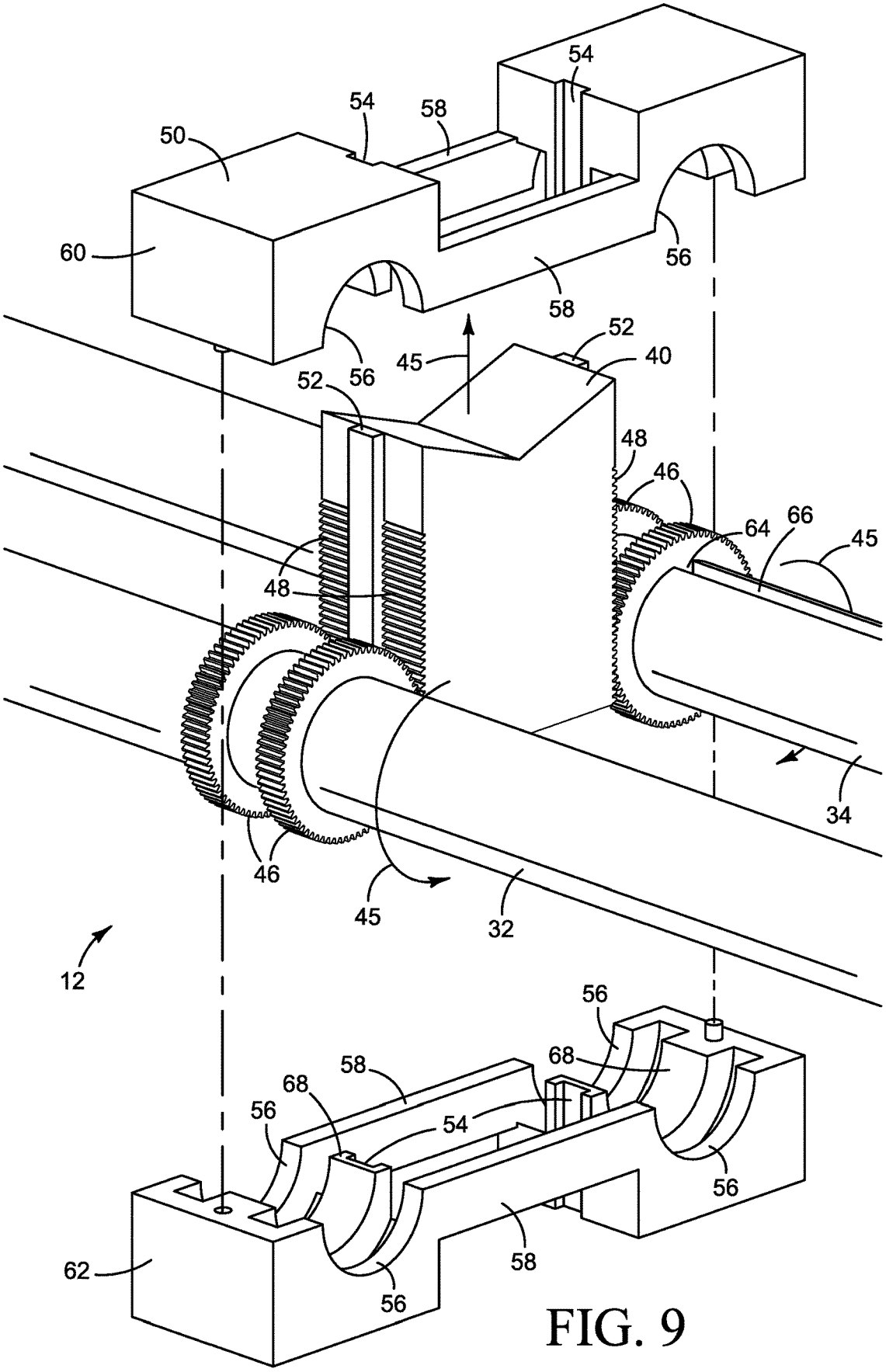

Referring now to the more detailed views of FIGS. 4-9, elevator 12 includes shafts 32, 34 and supports 40, 42 operatively connected to the shafts through a linear actuator 44. Actuator 44 converts rotation of shafts 32, 34 to translation of supports 40, 42 so that rotating the shafts in one direction raises the supports and rotating the shafts in the opposite direction lowers the supports. In FIG. 8, shaft 32 is rotated clockwise and shaft 34 is rotated counterclockwise to lower supports 40, 42, as indicated by direction arrows 43. In FIG. 9, shaft 32 is rotated counterclockwise and shaft 34 is rotated clockwise to raise supports 40, 42, as indicated by direction arrows 45. In the example shown, each actuator 44 is configured as a "rack and pinion" with circular gears 46 (called pinions) on shafts 32, 34 and linear gears 48 (called racks) on supports 40, 42. Each pinion 46 may be an integral part of the shaft as shown or a discrete part connected to the shaft. Each rack 48 may be a discrete part connected to the support, or an integral part of the support as shown.

Continuing to refer to FIGS. 4-9, elevator 12 also includes sliders 50 to slide supports 40, 42 along shafts 32, 34. Each support 40, 42 is operatively connected to a slider 50 through keys 52 on the support and keyways 54 in the slider. Each slider 50 includes openings 56 surrounding shafts 32, 34 for slider 50 to slide back and forth on the shafts. The lateral position of each support 40, 42 under a roll 14 may be adjusted by sliding slider 50 along shafts 32, 34. In addition to delivering the lateral motive force to supports 40, 42, the key/keyway connection also serves as a guide to help keep the supports aligned as they are raised and lowered by pinions 46. Other suitable connections between the slider and the supports are possible, however. For example, opposing sidewalls 58 of slider 50 abutting support 40, 42 could be used to move the supports back and forth with the sliders. Also, each slider 50 may be configured as an assembly of multiple parts—first and second parts 60, 62 in this example—to facilitate installing slider 50 on shafts 32, 34 and supports 40, 42.

Figure 5:
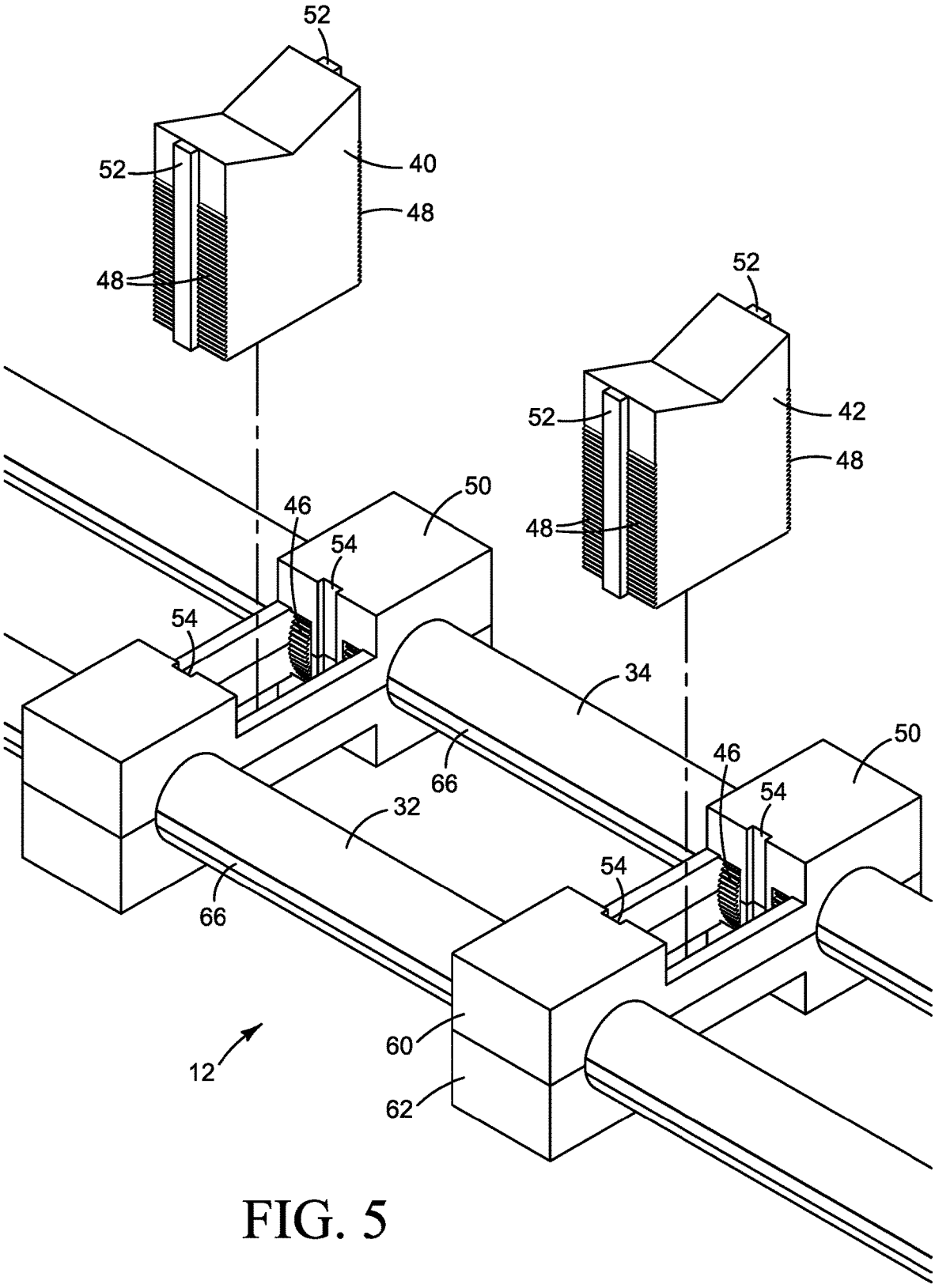
FIG. 5 illustrates the support assemblies of FIG. 4 with the supports exploded away from the sliders.
Figure 6:
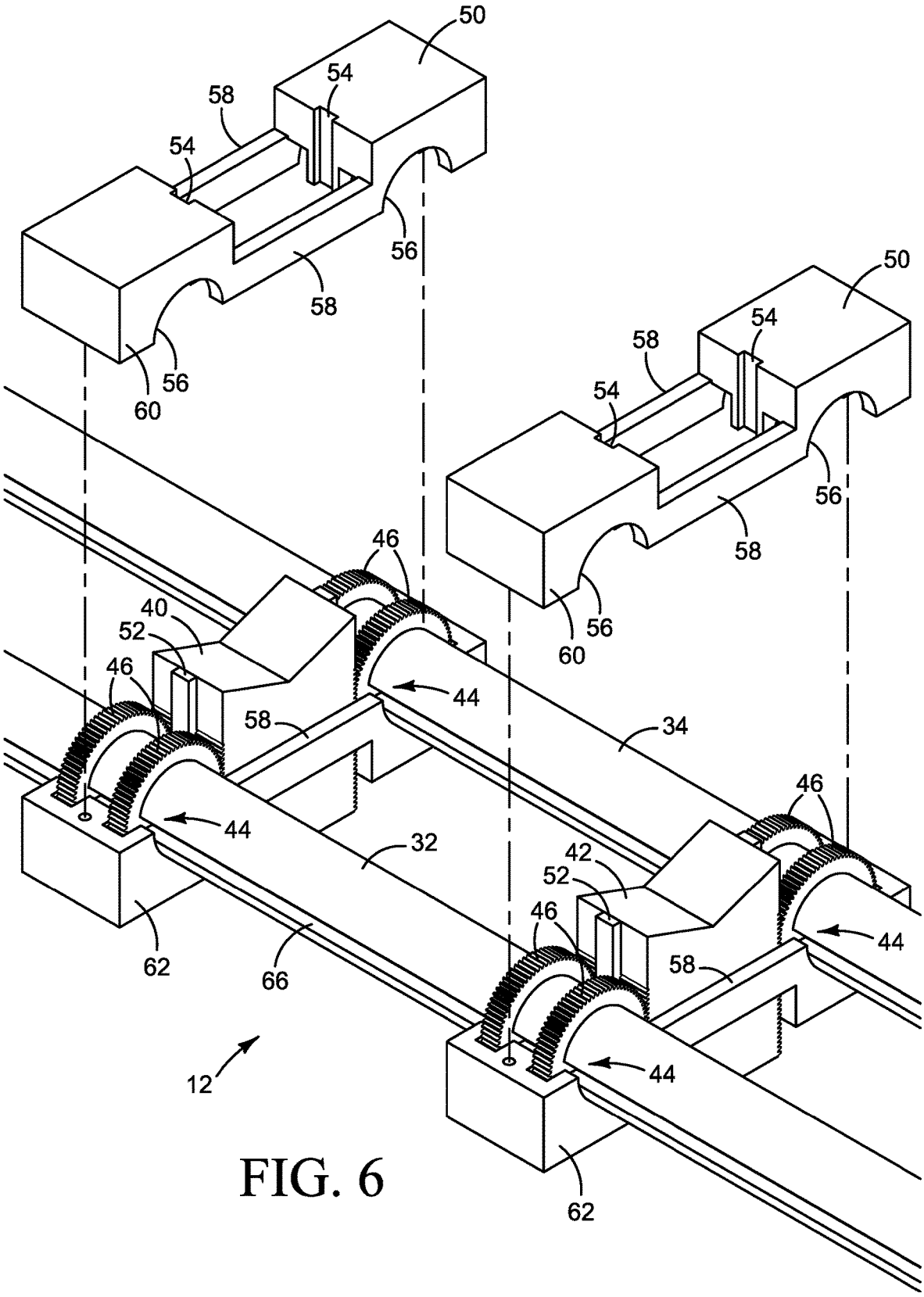
FIG. 6 illustrates the support assemblies of FIG. 4 with the sliders partially exploded away from the supports.
Figure 7:
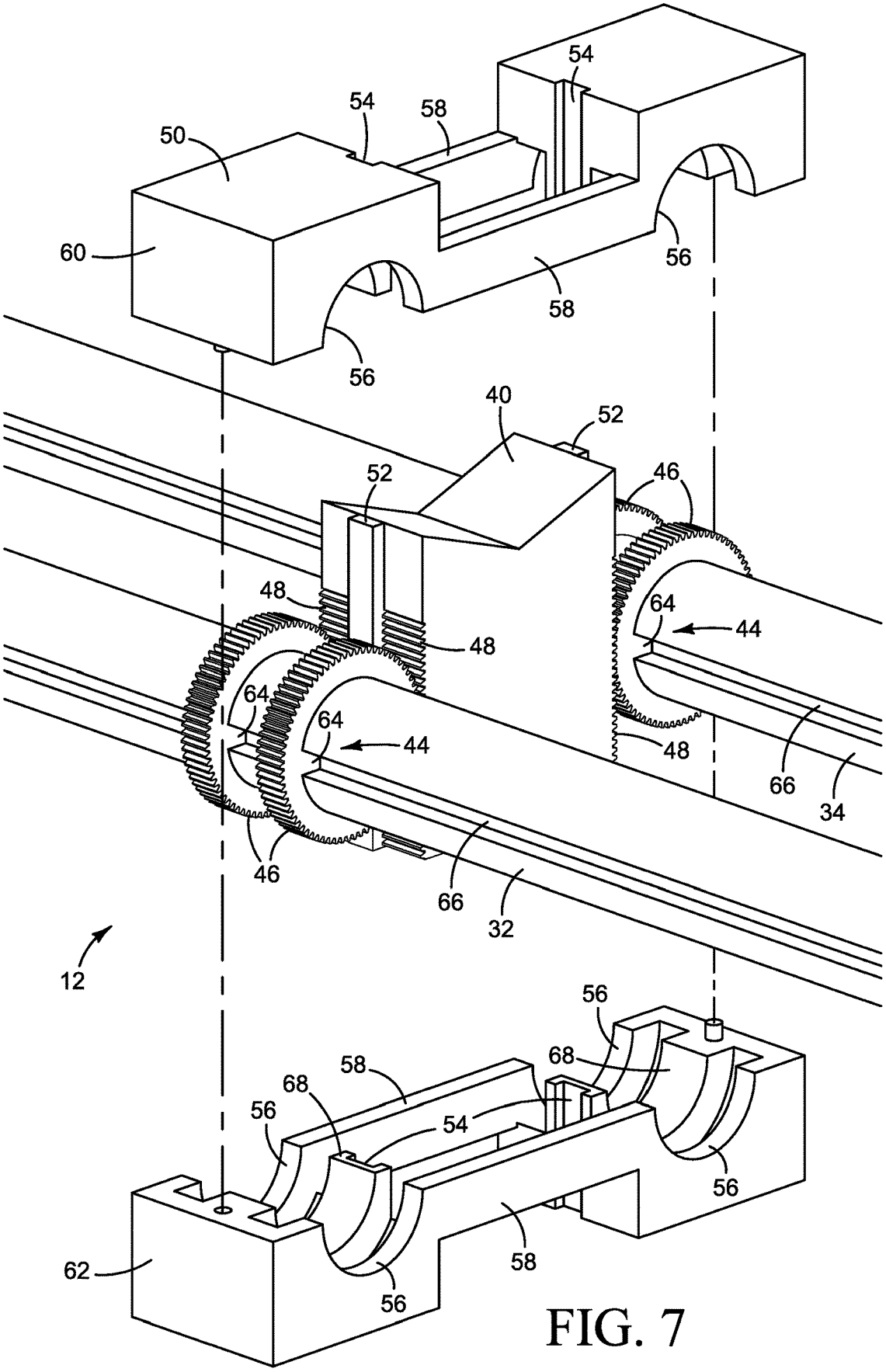
FIG. 7 is a detail showing one example of a linear actuator operatively connecting the supports and the shafts in the support assemblies of FIG. 4.

For pinions 46 to slide along shafts 32, 34 with the supports while still rotating with the shafts, each pinion 46 is operatively connected to the corresponding shaft 32, 34 through keys 64 on pinions 46 and keyways 66 on shafts 32, 34. Although a key/keyway connection between pinions 46 and shafts 32, 34 is shown, any suitable connection that allows the pinions to both rotate with and slide along the shafts may be used. Also, each pinion 46 is operatively connected to a slider 50 so that pinions 46 slide along shafts 32, 34 with supports 40, 42 at the urging of slider 50. In the example shown, as best seen in FIG. 5, pinions 46 are sandwiched between the exterior walls 58 and interior walls 68 of the sliders 50 to slide with the sliders.

Figure 10:
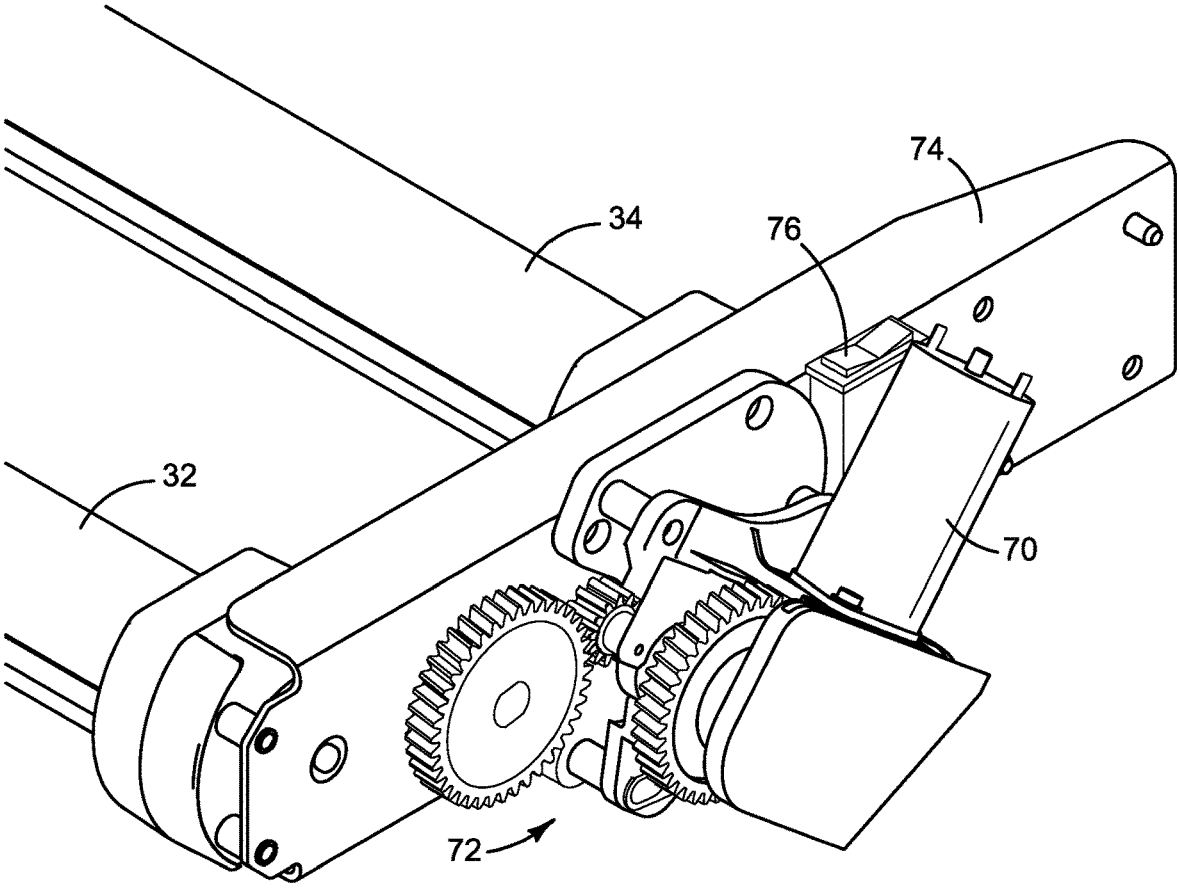
FIGS. 10 and 11 are close-ups of one example of a motor and drive train for turning the shafts in the elevator shown in FIGS. 1-3.
Figure 11:
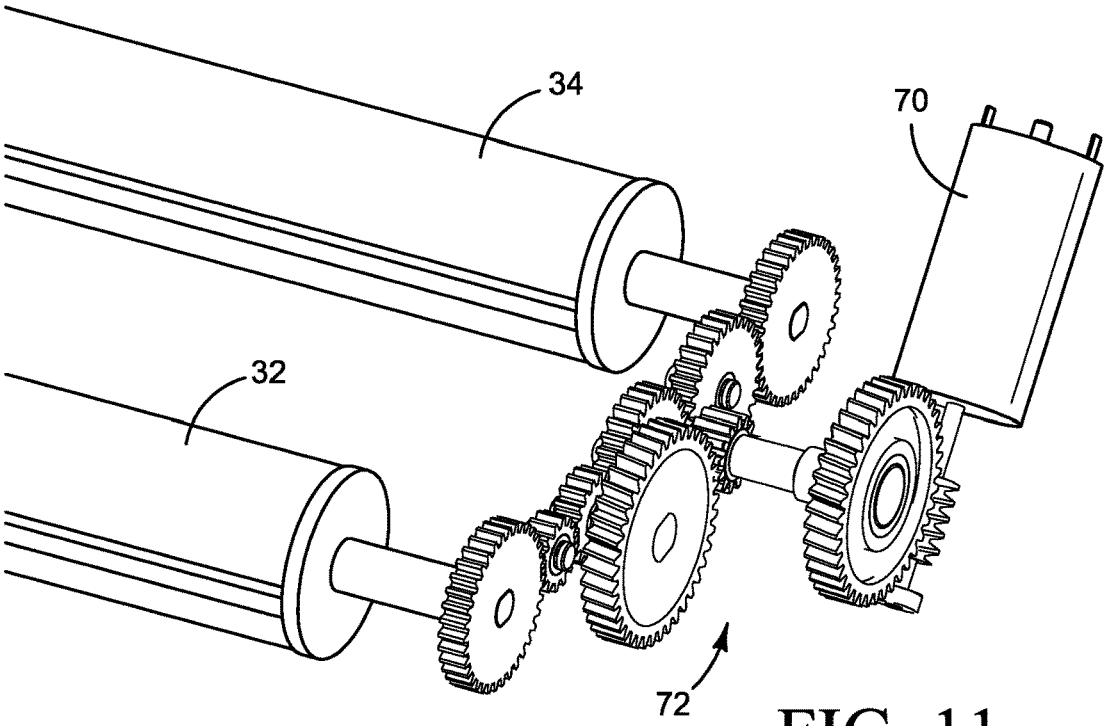

FIGS. 10 and 11 illustrate one example of a motorized drive train for turning shafts 32, 34. Referring to FIGS. 10 and 11, shafts 32, 34 are driven by a single, reversible electric motor 70 through a drive train 72. Motor 70 and shafts 32, 34 are mounted to a chassis 74 attached to stand 20. As best seen in FIG. 11, drive train 72 is configured as a reduction gear train to (1) develop the desired mechanical advantage to rotate shafts 32, 34 under the expected loads and (2) simultaneously rotate each shaft 32, 34 in the opposite direction. A rocker switch 76 or other suitable control device may be used to selectively energize motor 70 in the desired direction to turn shafts 32, 34 to raise or lower supports 40, 42.

Figure 12:
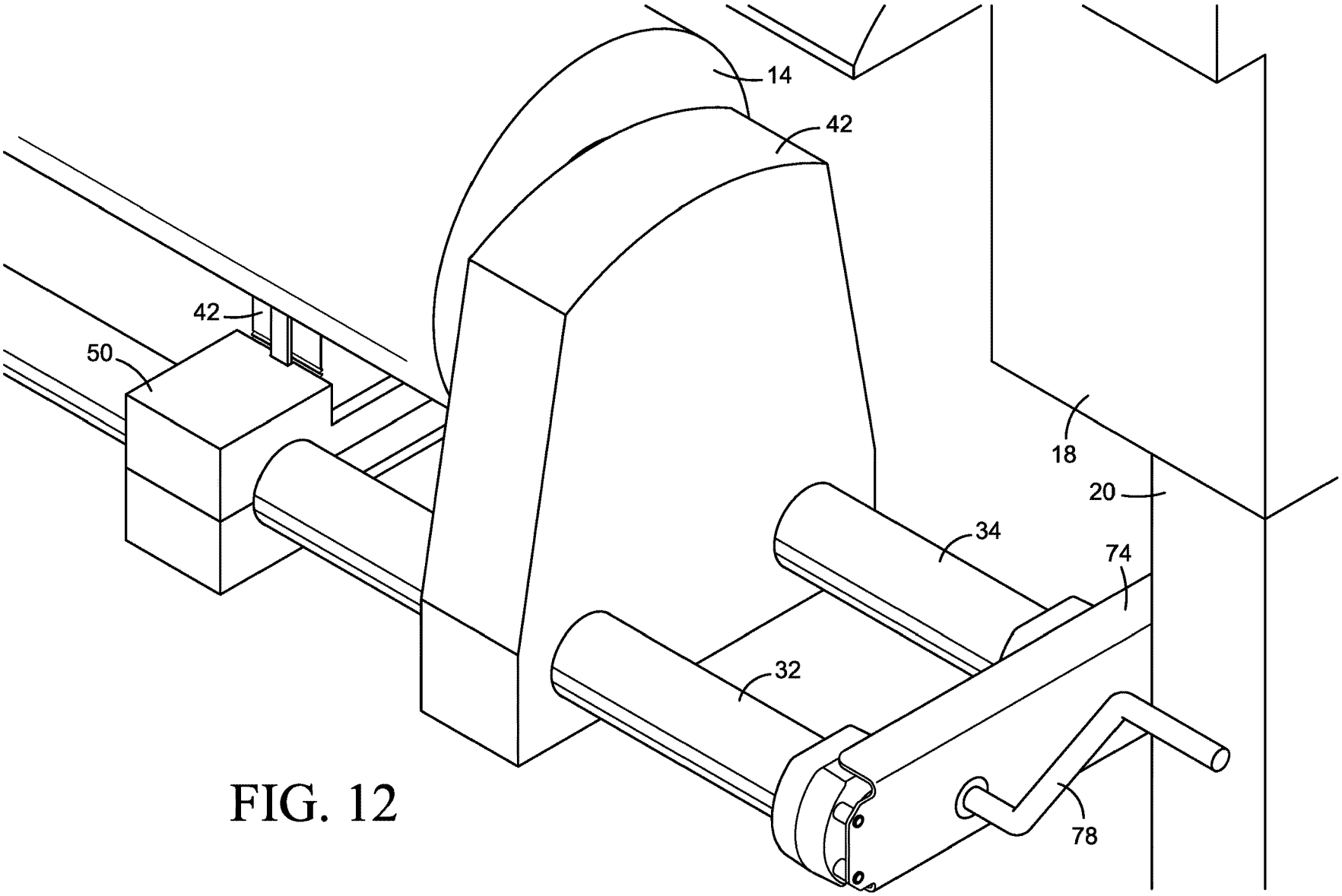
FIG. 12 illustrates one example of a hand crank and drive train for turning the shafts in the elevator shown in FIGS. 1-3.

In another example, shown in FIG. 12, a hand crank 78 is used to turn shafts 32, 34 through any suitable drive train (not shown).

Figure 13:
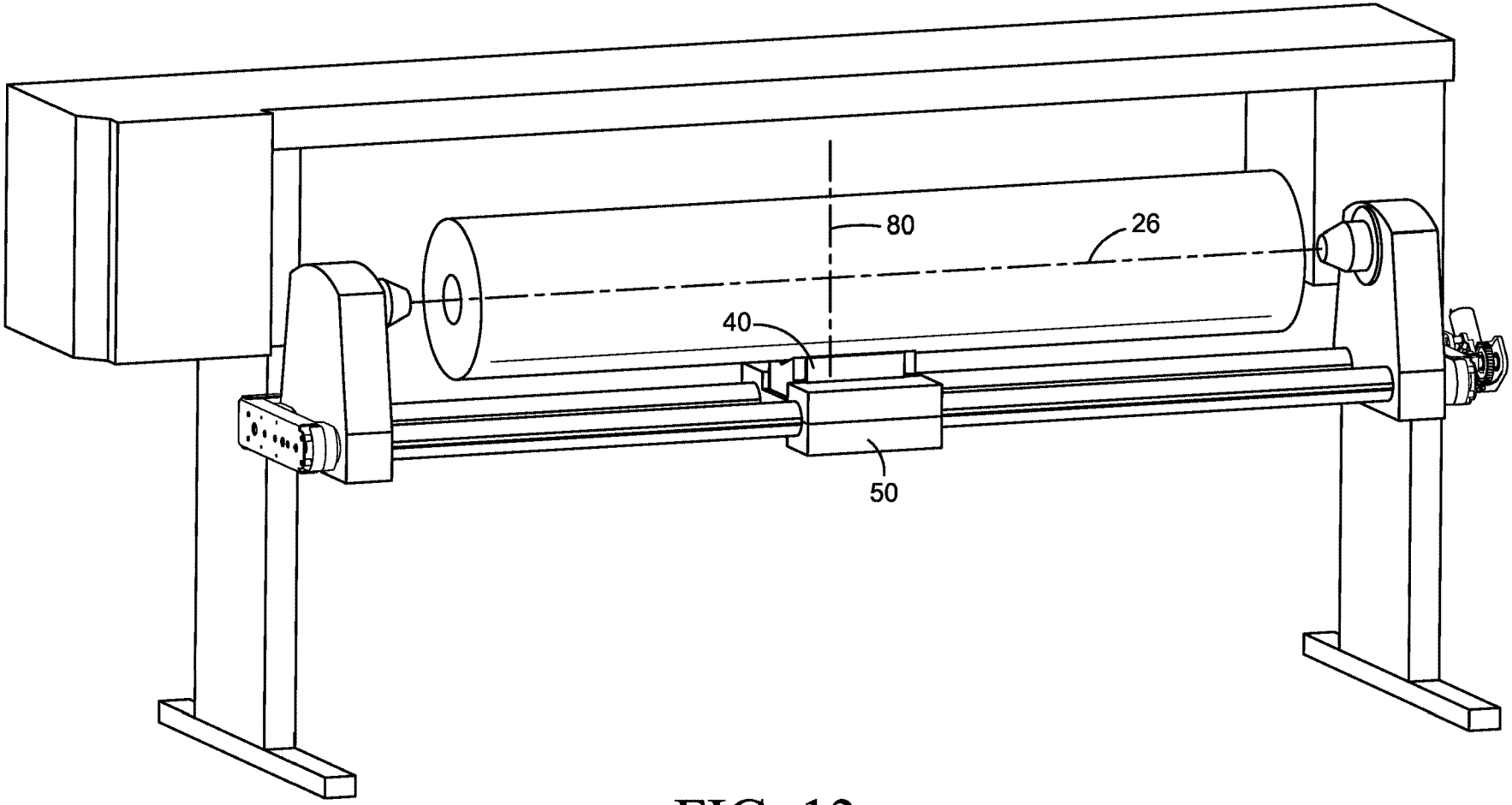
FIG. 13 illustrates a printer implementing another example of an elevator for loading a roll of print media into the printer.

In another example, shown in FIG. 13, a single support 40 straddling the centerline 82 of the print zone is used to support roll 14 during loading and unloading. As noted above, one of the advantages of a motorized elevator 12 is the ability to apply greater forces to lift heavier rolls, for example with a single support straddling the center of the roll as shown in FIG. 13 to raise and lower the roll from the center.

Figure 14:
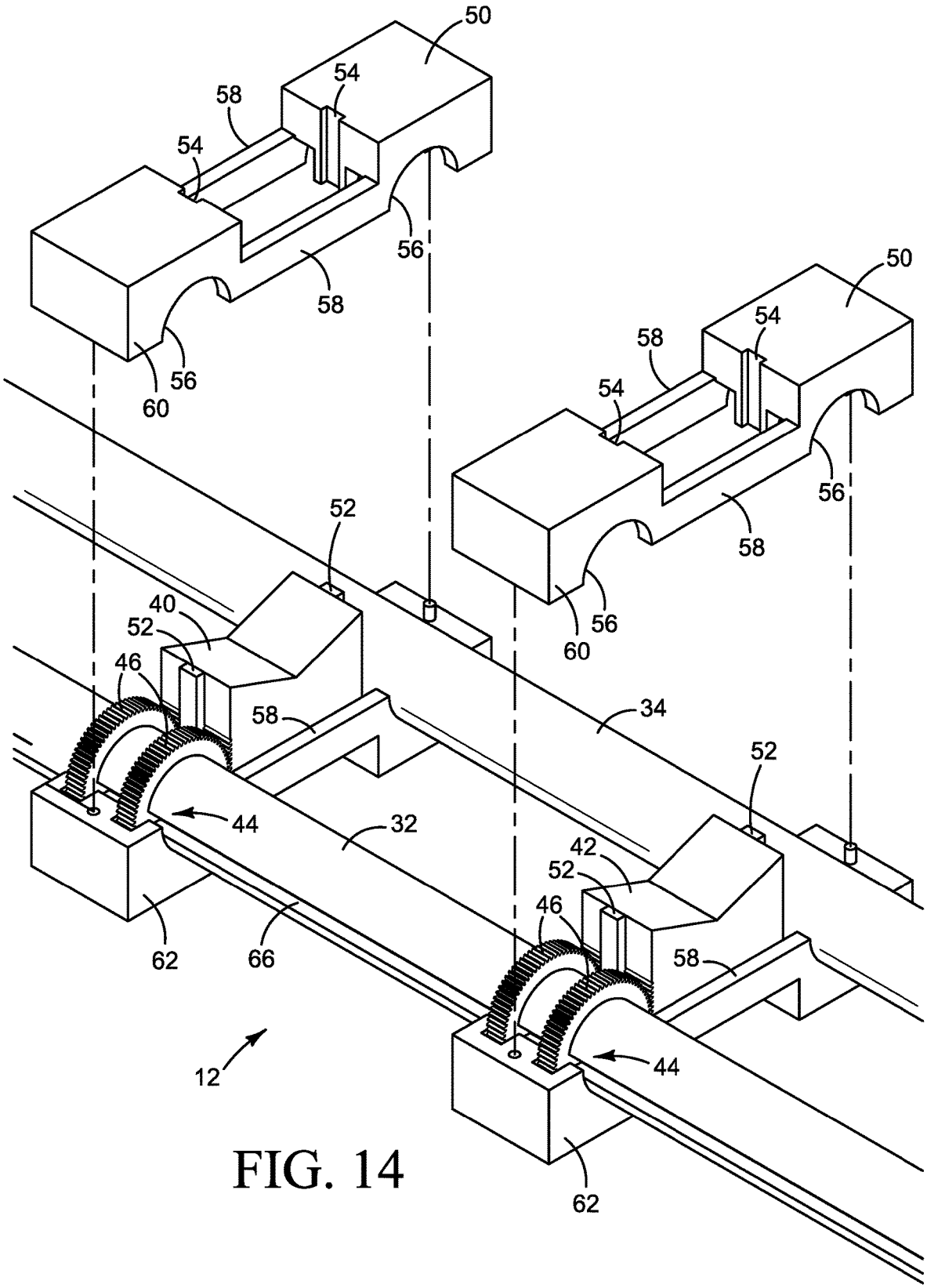
FIGS. 14 and 15 illustrate other examples of an elevator for loading a roll of print media into a printer.

In another example, shown in FIG. 14, supports 40, 42 are mounted to shafts 32 and 34 but raised and lowered by rotating a single drive shaft 32.

Figure 15:
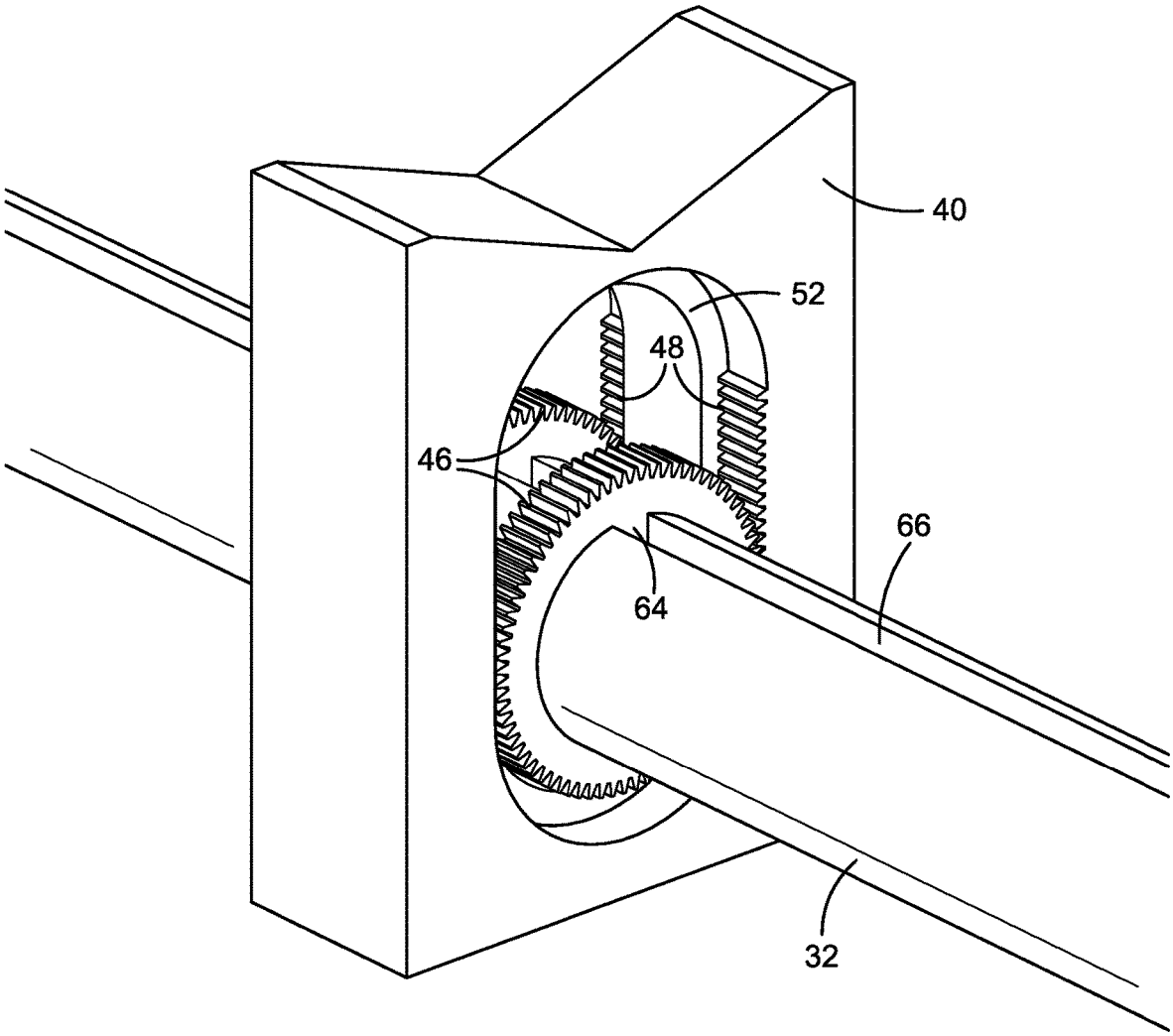

In another example, shown in FIG. 15, supports 40, 42 are mounted to and raised and lowered with a single shaft 32.

Figure 16:
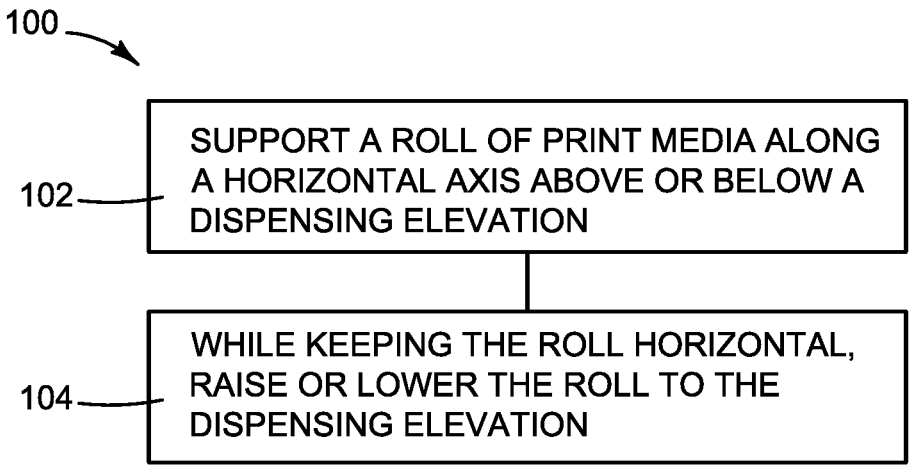
FIG. 16 is a flow diagram illustrating one example of a method for loading a roll of print media into a printer.

FIG. 16 is a flow diagram illustrating one example of a method 100 for loading a roll of print media into a printer. Referring to FIG. 16, a roll of print media is supported along a horizontal axis above or below a dispensing elevation (step 102) and then, while keeping the roll horizontal, raising or lowering the roll to the dispensing elevation (step 104) where it can be secured for print. The roll may be kept horizontal, for example, by raising or lowering both ends of the roll simultaneously. For another example, the roll may be kept horizontal by raising or lowering the roll from the center.

As noted at the beginning of this Description, the examples shown in the figures and described above illustrate but do not limit the invention. Other examples are possible. Therefore, the foregoing description should not be construed to limit the scope of the invention, which is defined in the following Claims.

What is claimed is:

1. An elevator for a roll of print media, the elevator including:

rotatable shafts oriented parallel to one another;

a drive train to mechanically couple the shafts to counterrotate simultaneously at a same rate; and translatable supports to support a roll of print media, each support operatively connected to the shafts, wherein rotation of the shafts raises the supports and opposite rotation of the shafts lowers the supports;

sliders slidable along the rotatable shafts, wherein each slider couples a translatable support to the rotatable shafts to allow the translatable support to be slidable along the rotatable shafts.

2. The elevator of claim 1, where each support is operatively connected to each shaft through a pinion on the shaft engaging a rack on the support.

3. The elevator of claim 2, where each pinion is slidable along the shaft with the support.

4. The elevator of claim 3, including an electric motor operatively connected to the drive train to counterrotate the shafts.

5. A holder for a roll of print media, including:

a first holder to hold a first end of the roll in a dispensing position;

a second holder to hold a second end of the roll in the dispensing position, the second holder opposite the first holder along an axis;

two shafts parallel to the axis below the holders;

a drive train to mechanically couple the shafts to counterrotate simultaneously at a same rate;

two pinions each rotatable with and surrounding a corresponding one of the shafts; and a support below the holders to support the roll in a loading position above or below or at a same elevation as the dispensing position, the support having two racks each connected to a corresponding pinion to raise and lower the support when the pinions are rotated;

where the support and the pinions are slidable together along the shafts.

6. The holder of claim 5, where:

each pinion is mounted to and surrounds the corresponding one of the shafts;

a key protrudes from an inner diameter of each pinion into a keyway extending lengthwise along the corresponding one of the shafts to transmit rotation of the corresponding one of the shafts to each pinion while allowing each pinion to slide along the corresponding one of the shafts; and the holder further comprising a slider operatively connected to the support and the pinions, the slider to slide the support and the pinions together along the shafts.

7. The holder of claim 5, including an electric motor operatively connected to the drive train to counterrotate the shafts.

8. The holder of claim 7, including a switch connected to the motor, the switch operable among a first position to energize the motor to rotate the shafts, a second position to energize the motor to rotate the shafts oppositely, and a third position is which the motor is not energized.

9. A method for loading a roll of print media into a printer, the method including:

sliding a translatable support disposed on parallel rotatable shafts along the parallel rotatable shafts, wherein the parallel rotatable shafts are coupled to counterrotate simultaneously at a same rate;

supporting a roll of print media along a horizontal axis above or below a dispensing elevation with the translatable support;

raising or lowering the roll to the dispensing elevation by rotating the parallel rotatable shafts; and keeping the roll horizontal while raising or lowering the roll to the dispensing elevation.

10. The method of claim 9, wherein the keeping includes raising or lowering both ends of the roll simultaneously.

11. The method of claim 10, wherein the raising or lowering includes motoring the roll to the dispensing elevation.

12. The method of claim 11, including securing the roll in the printer at the dispensing elevation.

13. The elevator of claim 1, further comprising:

a pinion rotatable with and surrounding a corresponding one of the shafts;

wherein each support includes a rack, each rack connected to a corresponding pinion to raise and lower a corresponding support when the corresponding pinion is rotated with the corresponding one of the shafts; and wherein the supports are to support the roll of print media in a loading position above or below or at a same elevation as a dispensing position, the dispensing position aligning the roll of print media to a first holder to hold a first end of the roll and an opposing second holder to hold a second end of the roll.

14. The holder of claim 5, further comprising:

two additional pinions each rotatable with and surrounding a corresponding another one of the shafts; and an additional support below the holders to support the roll in the loading position above or below or at the same elevation as the dispensing position, the additional support having two additional racks each connected to a corresponding additional pinion to raise and lower the support when the additional pinions are rotated.

* * * * *